United States Patent [19]

Glenn

[11] Patent Number: 4,941,261

[45] Date of Patent: Jul. 17, 1990

[54] KNIFE WITH WRIST BRACE

[76] Inventor: Robert A. Glenn, Rte. 6, Box 33, Cookeville, Tenn. 38501

[21] Appl. No.: 208,135

[22] Filed: Jun. 17, 1988

[51] Int. Cl.[5] ..... B26B 3/00

[52] U.S. Cl. ..... 30/296.1

[58] Field of Search ..... 30/142, 296 R, 298

[56] References Cited

U.S. PATENT DOCUMENTS

| | | | |
|---|---|---|---|
| 25,818 | 10/1859 | Goodall | 30/298 |
| 712,843 | 11/1902 | Paul . | |
| 907,345 | 12/1908 | Halfmann | 30/298 |
| 2,352,921 | 7/1944 | Stoltz . | |
| 2,504,880 | 4/1950 | Rittenhouse . | |
| 3,776,225 | 12/1973 | Lonardo . | |
| 3,938,509 | 2/1976 | Barber . | |
| 4,593,466 | 6/1986 | O'Brien | 30/296 R X |
| 4,593,466 | 6/1986 | O'Brien . | |
| 4,619,047 | 10/1986 | Heckman | 30/276 |

*Primary Examiner*—Frank T. Yost
*Assistant Examiner*—Eugenia A. Jones
*Attorney, Agent, or Firm*—Fleit, Jacobson, Cohn, Price, Holman & Stern

[57] ABSTRACT

A knife having a wrist brace associated therewith in the form of an elongated substantially rigid member having one end extending laterally and connected to a knife and the other end extending laterally and provided with a saddle engaging the upper surface of the forearm with the elongated member bridging the wrist joint and spaced vertically above the wrist joint to form a brace for the wrist when using the knife and enabling a user to more effectively use a knife for longer periods of time with less fatigue and muscle strain.

6 Claims, 1 Drawing Sheet

KNIFE WITH WRIST BRACE

BACKGROUND OF THE INVENTION

FIELD OF THE INVENTION

The present invention generally relates to a knife having a wrist brace associated therewith in the form of an elongated substantially rigid member having one end extending laterally and connected to a knife and the other end extending laterally and provided with a saddle engaging the upper surface of the forearm with the elongated member bridging the wrist joint and spaced vertically above the wrist joint to form a brace for the wrist when using the knife and enabling a user to more effectively use a knife for longer periods of time with less fatigue and muscle strain.

INFORMATION DISCLOSURE STATEMENT

Various types of hand tools have been provided with brace structures which usually involve a wrist encasing structure such as a leather or canvas member which tightly encircles the wrist to reinforce it. Such devices are not only used with hand tools but also with various items associated with athletic activities such as bowling, golfing and the like. Additionally, hand tools may be equipped with forearm encircling brace structures to facilitate use of the tool when the hand must exert substantial pressure on the tool. However, the prior art does not include a wrist brace structure that is disposed above the wrist and in bridging relation to the wrist joint in association with a knife to enable repetitive use of the hand during various butchering operations and the like to increase efficiency of use of the knife and reduce fatigue caused by repetitive use as lateral forces are exerted by the hand on the knife.

SUMMARY OF THE INVENTION

An object of the present invention is to provide a hand manipulated knife of conventional construction with a rigid handle and blade oriented in axial alignment combined with a wrist brace attached to the handle of the knife and extending upwardly therefrom and longitudinally above the wrist and forearm with the opposite end of the brace including a saddle of inverted U-shaped configuration engaged with the upper surface of the forearm region of the knife user thereby reinforcing and bracing the wrist joint to enable more efficient repetitive use of the knife and to reduce fatigue caused by such repetitive use.

Another object of the invention is to provide a combined knife and wrist brace in which the brace is of unitary construction with the knife handle and includes an elongated brace member having laterally offset ends and oriented above the knife, wrist and forearm with one offset end of the elongated member being rigidly associated and the knife handle and the other offset end including a bracket and saddle in stabilizing engagement with the forearm.

A further object of the invention is to provide a knife having a wrist brace associated therewith that is simple in construction, easy to use, effective in increasing the efficiency of use of the knife, effective in reducing fatigue which would normally result from repetitive use of the knife in various butchering operations and the like and is easily cleaned to maintain the required sanitary conditions for the knife.

Still another object of the invention is to provide a wrist brace for association with a manual knife or other similar tools requiring exertion of lateral force by the hand onto the hand tool with the brace effectively stabilizing and reinforcing the wrist joint to facilitate exertion of lateral force and reduce fatigue of the hand muscles, wrist joint muscles and forearm muscles that occur during repetitive use of such a tool.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENTS

Figure 1:
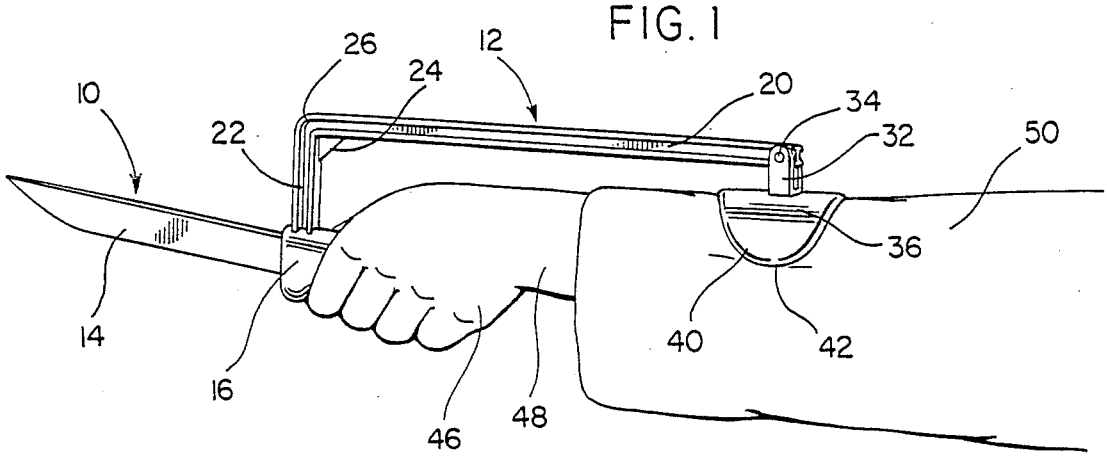
FIG. 1 is a side elevational view of the knife and wrist brace of the present invention illustrating the manner in which it is associated with the hand, wrist joint and forearm of a user.

Referring now specifically to the drawings, a knife incorporating the present invention thereon is designated by the numeral 10 and the wrist brace structure forming an integral part of the knife is designated by the numeral 12. The knife 10 is conventional and includes the usual sharpened and pointed blade 14 having a handgrip or handle 16 at one end thereof with the handgrip being of conventional construction and including recess areas 18 to receive the gripping fingers and to prevent the gripping hand from sliding forwardly into engagement with the sharpened knife blade 14. The knife blade and handle is of conventional construction except that the handle 16 is constructed of a plastic material molded in position with the wrist brace 12 being unitarily formed therewith in a manner set forth in more detail hereinafter.

Figure 4:
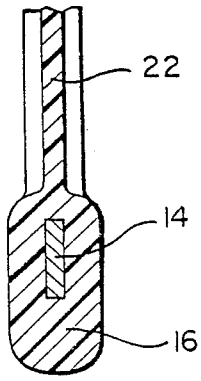
FIG. 4 is a transverse, sectional view taken substantially upon a plane passing along section 4—4 on FIG. 2 illustrating the manner in which the laterally extending end of the elongated brace member is unitarily constructed with the knife handle.
Figure 3:
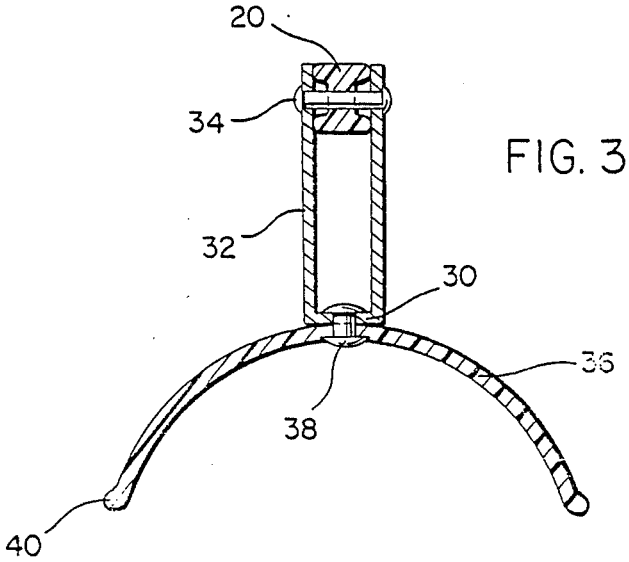
FIG. 3 is a transverse, sectional view taken substantially upon a plane passing along section 3—3 on FIG. 2 illustrating the structural details of the forearm engaging saddle and the connection between the elongated brace member and the saddle.

The wrist brace 12 includes an elongated brace member 20 having a laterally extending end portion 22 that is integral with the knife handle 16 as illustrated in FIG. 4. A reinforcing gusset 24 is formed at the corner 26 where the elongated member 20 and the laterally extending end 22 are connected. As illustrated in FIG. 3, the transverse, cross-sectional area of the brace member 20 and the laterally extending end 22 is in the configuration of an I-beam in order to provide lateral rigidity as well as longitudinal rigidity.

The other end of the elongated brace member 20 is provided with an elongated U-shaped bracket 28 having a bight portion 30 remote from the elongated brace member 20 with the legs 32 straddling the end of the elongated brace member 20 and being pivotally attached thereto by a rivet 34 or other similar fastening device. The lower end of the bracket 28 is attached to the central portion of a generally inverted U-shaped or semi-circular forearm saddle 36 by a rivet 38 or other similar fastener as illustrated in FIG. 3. The downwardly opening forearm saddle 36 includes outwardly flared lower end portions at 40 and the side edges of the saddle 36 are curved generally in a semi-circular configuration as indicated by the numeral 42 and as illustrated in FIGS. 1 and 2.

Figure 2:
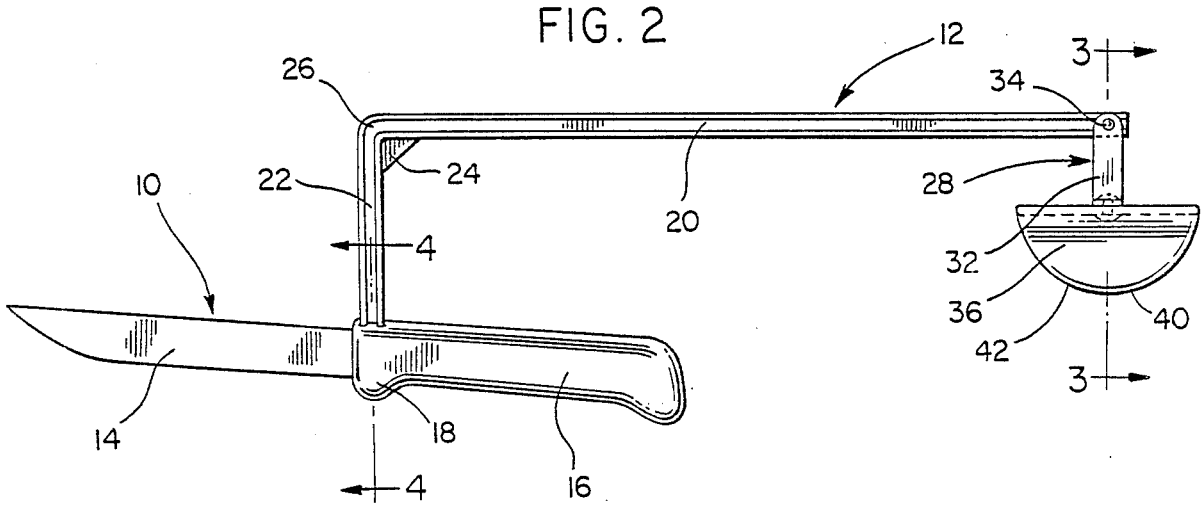
FIG. 2 is a side elevational view of the knife and wrist brace combination.

With the brace 12 being unitary and integral with the knife handle 16, the person using the knife and brace will grasp the handle 16 in their hand 46 in a conventional manner with the wrist joint 48 being disposed in underlying, spaced relation to the elongated brace member 20 as illustrated in FIG. 1 with the saddle 36 engaging the upper surface of the forearm 50 which arrangement maintains the wrist joint 48 in alignment and in underlying relation to the brace member 20 thereby precluding the wrist joint 48 from any substantial lateral movement in relation to the elongated brace member 20 thus reinforcing and stabilizing the wrist joint when lateral forces are exerted by the hand on the knife handle and blade. Likewise, when downward forces are exerted on the knife blade by the hand, the wrist joint will be stabilized since the tendency of the knife handle to pivot downwardly in relation to the knife blade which is engaged with the material being cut is resisted by the rigid association of the knife handle 16, the end member 22, the elongated brace member 20 and the saddle 36 engaged with the forearm in bridging relation to the wrist joint thus reinforcing and stabilizing the wrist joint when vertical forces are applied to the knife handle by the hand 46 of the user. One of the significant features of this invention is that the saddle and the wrist brace is not attached to the forearm but it actually lays on or engages the upper surface of the forearm and can move more or less freely longitudinally along the upper surface of the forearm but it will relieve the pressure that is associated with the wrist joint by keeping the wrist joint substantially straight at all times and by transferring some of the pressure to the forearm. This structure and function reduces the possibility of a knife user suffering from carpal tunnel syndrome and other similar wrist problems. This increases the efficiency of use of the knife and also reduces fatigue that occurs during repetitive use. By reducing fatigue, the incidence of injury due to use of the knife is reduced since the user of the knife has better control of the knife and can maintain cutting operations for a longer period of time.

While the brace structure has been illustrated in unitary construction with the knife handle, the brace may also be detachably associated with the knife handle by using various detachable but rigid connections which do not alter the capability of the knife handle being effectively grasped by the user's hand 46. When the handle of the knife is constructed of a moldable plastic material, the brace 12 may be integrally molded therewith to lower the manufacturing costs and provide a rigid brace that is unitary with the knife and which can be maintained in sanitary conditions in the same manner that the knife is cleaned. However, if the knife handle is of wood or other material, the brace 12 may be rigidly affixed to the forward end portion of the handle in any suitable manner. One alternative structure includes the use of an extension on the end 22 of the brace which overlies the upper surface of the knife handle and which is gripped by the hand 46 of the user at the same time that the user is gripping the handle 16 thus forming a connection between the handle and the wrist brace.

The foregoing is considered as illustrative only of the principles of the invention. Further, since numerous modifications and changes will readily occur to those skilled in the art, it is not desired to limit the invention to the exact construction and operation shown and described, and, accordingly, all suitable modifications and equivalents may be resorted to, falling within the scope of the invention.

What is claimed as new is as follows:

1. A knife having a handle and blade oriented in axial alignment with the handle adapted to be gripped by a user, a wrist brace for connection with the handle and extending above the wrist joint and forearm of the user of the knife, said wrist brace including an elongated substantially rigid brace member disposed above the wrist joint and forearm and including a laterally extending end portion rigidly connected with the knife handle, the other end of the elongated brace member including a laterally extending saddle engaged with but not rigidly associated with the forearm of the user to reinforce and brace the wrist joint to maintain the wrist joint in underlying relation with the elongated brace member during use of the knife and resisting deflection of the wrist joint when applying vertical pressure on the knife handle, said saddle being an inverted, downwardly opening semi-cylindrical member having curved side edges engaging the upper surface of the forearm, said saddle being connected to the end of the elongated brace member remote from the knife handle by a bracket structure that spaces the saddle laterally from the elongated brace member, said elongated brace member being substantially straight, said bracket being pivotally connected to the end of the brace member remote from the knife handle by a transverse fastening structure to enable pivotal movement of the saddle about an axis transverse to the longitudinal axis of the elongated brace member and transverse to the forearm.

2. The structure as defined in claim 1 wherein said saddle is connected to the bracket remote from its connection to the elongated brace member by pivot means enabling the saddle to swivel about an axis generally coincidental to the longitudinal axis of the bracket and perpendicular to the pivot axis connecting the bracket to the end of the elongated brace member.

3. The structure as defined in claim 2 wherein said knife handle and laterally extending end of the elongated brace member are of unitary construction with the laterally extending end portion of the elongated brace member being located adjacent the juncture between the knife handle and knife blade.

4. A wrist brace for a knife user including an elongated substantially straight and rigid brace member adapted to be disposed in vertically overlying relation to the wrist joint of a person grasping and utilizing a manual knife, means at one end of the brace member for substantially rigid connection to the knife, and means at the other end of the elongated brace member engaging the upper surface of the forearm without being connected thereto to reinforce the wrist joint to maintain alignment of the wrist joint with the elongated brace member and to maintain a spaced relation between the wrist joint and elongated brace member, said elongated brace member including a laterally extending end extending downwardly into contacting rigid mounting engagement with the knife handle, said means at the other end of the elongated brace includes a saddle in the form of a downwardly opening, arcuately curved member generally conforming with and engaging the upper surface of the forearm, means supporting the saddle from the elongated brace member for pivotal movement about perpendicular axes and in spaced relation to the elongated brace member to maintain the brace member in spaced vertical relation above a wrist joint of a person grasping and manually using a knife for reinforcing and stabilizing the wrist joint to enable more efficient use of the knife, reduce fatigue and reduce carpal tunnel syndrome.

5. A wrist brace for the user of a knife having an elongated handle and blade means at one end of the handle, said brace comprising an elongated rigid member extending in bridging relation to the wrist joint of a person using the knife by grasping the handle, means at one end of the rigid member for connection with the knife, means at the other end of the rigid member for engagement with the forearm of the user in spaced relation to the wrist joint to reinforce and stabilize the wrist joint when cutting pressure is exerted on the knife handle by the user, said means connecting said one end of the rigid member to the knife being the sole connection between the rigid member and knife, said means for engagement with the forearm including a generally transversely arcuate saddle conforming with the exterior of the forearm, and means connecting the saddle to the end of the elongated rigid member to enable relative movement therebetween, said means connecting the saddle to the rigid member including a bracket connected to the end of the rigid member by pivot means enabling pivotal movement of the bracket and saddle about an axis transverse to the longitudinal axis of said rigid member, said bracket and saddle being interconnected by a swivel means enabling the saddle to swivel about an axis perpendicular to said transverse axis and said longitudinal axis.

6. The structure as defined in claim 5 wherein said one end of said rigid member is rigidly connected to the knife by a laterally extending rigid member.

* * * * *